United States Patent [19]

Matthews

[11] Patent Number: 5,066,430

[45] Date of Patent: Nov. 19, 1991

[54] PROCESS FOR CENTRIFUGALLY SPINNING PITCH CARBON FIBERS

[75] Inventor: Abraham Matthews, Wilmington, Del.

[73] Assignee: E. I. du Pont de Nemours and Company, Wilmington, Del.

[21] Appl. No.: 326,554

[22] Filed: Mar. 20, 1989

[51] Int. Cl.[5] ..... D01D 5/18

[52] U.S. Cl. ..... 264/8; 264/29.2; 264/211.11; 425/8

[58] Field of Search ..... 425/8; 264/29.2, 5, 264/8, 211.11

[56] References Cited

U.S. PATENT DOCUMENTS

| | | | |
|---|---|---|---|
| 3,776,669 | 12/1973 | Ito et al. | 425/8 |
| 4,032,607 | 6/1977 | Schulz | 264/29.3 |
| 4,323,524 | 4/1982 | Snowden | 264/8 |
| 4,356,228 | 10/1982 | Kobayashi et al. | 428/283 |
| 4,497,789 | 2/1985 | Sawran et al. | 264/29.2 |
| 4,746,470 | 5/1988 | Fujimaki et al. | 425/8 |
| 4,762,652 | 8/1988 | Miyamori et al. | 264/29.2 |
| 4,808,097 | 2/1989 | Takahashi et al. | 425/8 |
| 4,861,653 | 8/1989 | Panish | 264/29.2 |
| 4,898,634 | 2/1990 | Keuchel | 264/8 |

FOREIGN PATENT DOCUMENTS

| | | | |
|---|---|---|---|
| 44-901 | 1/1969 | Japan | 425/461 |
| 58-203105 | 11/1983 | Japan . | |
| 60-167907 | 8/1985 | Japan | 264/8 |
| 60-173121 | 9/1985 | Japan . | |
| 61-22044 | 5/1986 | Japan . | |
| 2095222 | 9/1982 | United Kingdom . | |
| 2177733 | 1/1987 | United Kingdom . | |

OTHER PUBLICATIONS

Extended Abstracts of the 16th Biennial Conference on Carbon, 1983, pp. 515, 516.

Composites Science and Technology, 25, 1986, pp. 231–241.

*Primary Examiner*—Hubert C. Lorin

[57] ABSTRACT

Mesophase pitch centrifugally spun over a lip of the centrifugal rotor can be protected from coke and tar formation by conveying the molten pitch to the rotor's lip through channels within the rotor.

6 Claims, 3 Drawing Sheets

PROCESS FOR CENTRIFUGALLY SPINNING PITCH CARBON FIBERS

BACKGROUND OF THE INVENTION

The centrifugal spinning of fibers from pitch is known in the art. U.S. Pat. No. 4,861,653 teaches a process for centrifugally spinning carbon fibers which have an isoclinic microstructure which imparts excellent thermal and electrical conductivity to the fibers. However, the process taught in that application is subject to interruption due to degradation of the pitch which results in accumulation of tar, coke and other impurities in the rotor which in turn interfere with continuous spinning.

The present invention provides improved throughput of pitch and yields sub-denier pitch carbon fibers with isoclinic microstructure which are particularly useful as reinforcement in polymer matrix composites and for the enhancement of the thermal and electrical conductivity thereof.

THE DRAWINGS

FIG. 1 is a schematic of a spinning and laydown apparatus for preparing fibers of the desired microstructure.

FIG. 2 is a cross-sectional view of the spinning rotor shown in FIG. 1, taken in a plane which includes the axis of the drive shaft.

FIG. 3 shows a scanning electron photomicrograph (SEM) of a definitive fiber fracture surface observed in fiber cross sections of products of the invention.

SUMMARY OF THE INVENTION

This invention provides an improved process for centrifugally spinning carbon fibers from mesophase pitch. Molten mesophase pitch, preferably 100% mesophase pitch, is spun at 375°-525° C. over the lip of the rotor with a centrifugal force of from 200 to 25000 g., preferably at least 1000 g. The improvement comprises separating molten pitch within the rotor into multiple discrete streams which pass from a central chamber holding the molten pitch through channels in the rotor which extend to the lip. The channels are preferably tubular conduits, more preferably cylindrical conduits. In a preferred embodiment the cylindrical conduits have an inlet or upstream portion with a length, $L_1$, and a diameter, $D_1$, connected to a discharge or downstream portion having a length, $L_2$, and a diameter, $D_2$ .$D_2$ is preferably from 20 to 100 mils. The preferred relationships among these variables are $L_1/D_1=(k)L_2/D_2$ where k is from 1.5 to 2, $L_2/D_2$ is from 5 to 10, and $D_2/D_1$ is equal to or less than 0.5. In a preferred rotor the inlet portion of the conduit is positioned at an angle on incline of from 5 to 15 degrees to the axis of the rotor, and the downstream portion of the conduit is positioned at an angle of from 55 to 65 degrees to the axis of the rotor. The rotor useful in this process is also an element of this invention.

DETAILED DESCRIPTION OF THE INVENTION

The process employed in preparing the products of this invention consists essentially of centrifugally spinning a mesophase pitch, at elevated temperatures, over a lip, at centrifugal forces in excess of 200 times the force of gravity (i.e., in excess of "200 g's"). The use of mesophase pitch is believed to be critical. It is also believed critical that the pitch be spun without circumferential restraint, such as over a lip, in order to permit the extensional flow of a planar, shear-oriented film of molten pitch. It is this spinning without restriction over a lip that produces the desired isoclinic microstructure of the carbon fibers. Conventional centrifugal spinning of pitch through confining or shaping orifices, e.g., nozzles, generally limits throughput, provides larger fibers and, with highly mesophasic pitch, spinning continuity often may be limited by plugging. Such spinning also will not result in the lamellar fiber microstructure. For example, use of mesophase pitch in conventional centrifugal spinning (GB 2,095,222A) results in a "random mosaic" microstructure.

In U.S. Pat. No. 4,861,653, the word "lip" was used to describe the full perimeter of the rotor over which the pitch was discharged. As used here, "lip" refers to the inner surface of the channel in which the pitch flows where the channel reaches the outer periphery of the rotor. Centrifugal spinning of mesophase pitch over a lip requires relatively high spinning temperatures and centrifugal forces in order to produce fine-denier fibers. Although the streams of pitch flow to the lip through conduits in the rotor, these conduits, at least at the lip, are not filled with pitch. The pitch fills only a segment of the conduit at the lip. Thus, it is not the shape of the opening at the lip, but the fact that the flow is unrestrained that determines the isoclinic microstructure of the resulting fibers.

The conduits in the rotor are arranged uniformly around the axis of the rotor to permit balanced rotation. The inlet of each conduit connects to the central chamber holding molten pitch. The inlet is placed nearer the axis of rotation than the outlet at the lip, so that rotation of the rotor provides force to move pitch through the conduits. Channelling the pitch through these conduits provides two advantages over the use of a rotor without such conduits. First, since the stream of pitch is not spread out as a thin film over a large surface, decomposition of the pitch and formation of tar and coke due to contact with the hot metal surface of the rotor is minimized. Second, confining the pitch in conduits permits volatile compounds evaporating from the pitch to blanket the pitch and minimizes decomposition of the pitch from reactions with the atmospheric oxygen.

Centrifugal forces of at least 200 g's, preferably more than 1000 g's and as high as 25,000 g's have been found useful. If the centrifugal force or temperature during spinning is too low, only particles rather than fibers may be produced. The nature of the pitch and the particular configuration of the spinning apparatus will determine the optimum spinning conditions. Rotor temperatures at least 100° C. above the pitch melting point should be employed for spinning. Temperatures of at least 375° C. and preferably within the range of 450 to 550° C. have been found useful for spinning pitches with melting points between 290 and 325° C. Excessively high temperatures are to be avoided since they lead to coke formation. A pitch having a mesophase content of about 100% will normally require a higher spinning temperature than a pitch of lower mesophase content. The melt viscosity of the pitch is normally determined by the extent to which the spinning temperature exceeds the melting point of the pitch.

In accordance with the present invention one obtains, in an economic manner, fine denier carbon fibers with a unique lamellar or isoclinic microstructure from centrifugally spun mesophase pitch. In general, the fibers have a cross-sectional width of less than about 12 micrometers (microns), usually from about 2 to 12 micrometers. The actual denier of such fibers will depend on the density as well as the size of the particular fiber which may, in highly graphitic structures (density >2.0 g/cc), numerically exceed 1.0 denier per filament (dpf). The fiber widths are variable and may be measured on an SEM of known magnification. The variation of widths best fits a "log-normal" distribution. Most useful fibers have widths in the range 2–10, or preferably 3–6 micrometers. The fiber lengths also are variable and preferably exceed about 10 mm. in length. The fibers may have "heads", that is, an end segment with a diameter or width that is greater than the remainder or the "average" of the fiber. It is preferred that these "heads" be minimized because they do not add value in most end-use applications. The "heads" should be ignored in taking measurements of the fiber dimensions, especially widths. The size and shape of the "heads" is influenced by the level of force in spinning, the spinning temperature, the nature of the pitch, the spin apparatus and also can be influenced by quenching conditions.

The fibers made by this invention provide higher thermal conductivity to composite materials in which they are incorporated than conventional carbon fibers. The laminar microstructure of the fibers contributes to this increased conductivity. Also, since the fibers are very fine in diameter, they will provide a larger number of conductive pathways than the same mass of larger diameter fibers incorporated in a composite structure.

By "mesophase pitch" is meant a carbonaceous pitch, whether petroleum or coal-tar derived, having a mesophase content of at least about 40 percent, as determined optically utilizing polarized-light microscopy. Mesophase pitches are well-known in the art and are described, inter alia, in U.S. Pat. No. 4,005,183 (Singer) and U.S. Pat. No. 4,208,267 (Diefendorf and Riggs). Fibers prepared from centrifugally spun isotropic pitches generally do not exhibit a discernable microstructure, are tedious to stabilize and often exhibit relatively poor mechanical properties. In contrast, fibers produced from the process of this invention show fracture surfaces with a distinct lamellar or layered microstructure readily observed when such fracture surfaces are viewed at magnifications of 5,000× or higher, especially after the fibers have been exposed to temperatures in excess of about 2000° C. The lamellae are disposed in a direction generally parallel to an axis (usually the major axis) of the cross-section and extend to its periphery. It is believed that this microstructure is evidence of a very high degree of structural order and perfection, and further that such a highly ordered structure explains the enhanced thermal and electrical conductivity of such fibers.

The fibers of this invention are advantageously prepared in the form of batts. Batts can be produced in a range of areal densities for the reinforcement end-uses contemplated herein, should lie between 15 and 600 g/m$^2$. To prepare the batts, the pitch fibers are centrifugally spun into a collection zone and are then advantageously directed onto a moving porous belt. The fibers are ordinarily randomly arrayed within the plane of the batt, that is, no particular pattern is displayed. The areal density or basis weight of the batt can be varied by the rate of pitch deposition on the belt (pitch throughput rate) or preferably by adjusting the velocity of the moving belt or other collection means.

After spinning and collecting the fibers in batt form, the batt of as-spun fibers is subjected to stabilization. Surprisingly, this step proceeds at a much faster rate than normally expected with conventionally spun pitch carbon fibers. The invention permits use of lower stabilization temperatures and shorter periods of stabilization. If desired, the conditions of stabilization, e.g., higher temperatures, may be employed to achieve self-bonding of the as-spun fibers of the batt at their contact or crossover points. Stabilization is usually affected by heating in air at temperatures between 250° C. to 380° C. for a time sufficient to enable later precarbonization without melting. Depending on stabilization temperature, the fibers in the batt will remain free of one another and may be later separated. At higher stabilization temperatures self-bonding will take place. Self-bonding may be assisted by employing lateral restraint, such as placement of the batt between screens with minimal compression to offset shrinkage forces. There results from self-bonding a three-dimensional, unitary network of fibers which, after carbonization, yields a structure suitable for impregnation. The self-bonded batt may be broken into fibrous fragments (mixture of straight fibers and "X", "Y", etc. shaped bonded fragments) and can be employed as a reinforcement material. Properly stabilized batts may be combined for later ease of processing. For example, batts may be laid up and needled to prevent delamination and thereafter processed conventionally.

After stabilization, the fibers or batts are devolatilized or "precarbonized" in an inert gas atmosphere (nitrogen, argon, etc.) at temperatures between 500° C. and 1000° C., preferably between 600° C. and 800° C. This step rids the fibers of the oxygen picked up in stabilization in a controlled manner and increases the carbon-hydrogen ratio, thereby increasing melting temperature. Ordinarily, the fibers and batts are carbonized or carbonized and graphitized in accordance with art-recognized procedures, i.e., at temperatures from about 1600° C. to 3000° C. in an inert atmosphere for a time of at least twenty seconds. It is the carbonized or carbonized and graphitized fiber that exhibits the lamellar structure referred to previously. The batts may be surface treated, by known methods, to enhance fiber-to-matrix adhesion in composites end-use applications. The fibers in the batt may be bonded to each other through use of an adhesive and such bonded batts may be laid up and additionally bonded to each other. If desired, the fibers or batts can be combined with other fibers (e.g., glass, aramid, etc.) or batts thereof to provide "hybrid" batts, mixed laminates, etc.

The fibers as laid in the batt are of relatively short length. A decreasing feed rate or throughput has been found to yield fibers of increased length. The temperature of the pitch can be adjusted by the external heating means (e.g., the induction coil), thereby altering its viscosity.

Rotors having a diameter of about eight inches have been used successfully. If desired, quenching gases to accelerate or delay the solidification of the molten pitch upon leaving the rotor may be accommodated in the spinning apparatus.

Figure 2:
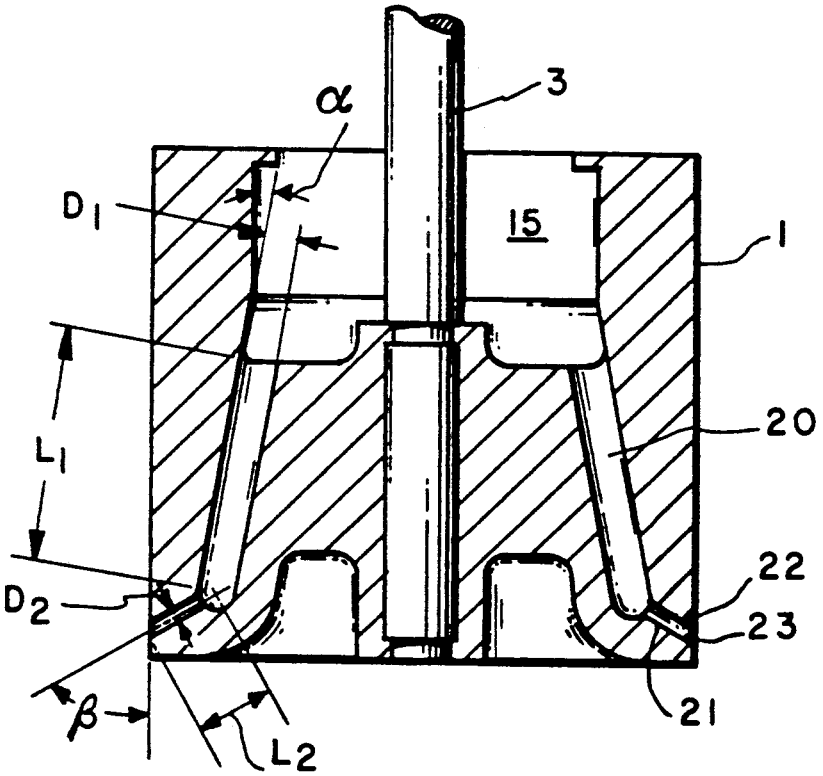

Referring to FIG. 2, rotor 1 is attached to drive shaft 3. Rotor 1 is a solid member having a plurality of circumferentially and regularly spaced pitch supply holes 20 feeding an equal number of pitch spinning holes 21. Each of pitch supply holes 20 is characterized by its diameter ($D_1$), length ($L_1$) and angular disposition "alpha" from the vertical. Each of the corresponding pitch spinning holes 21 is similarly characterized by its diameter $D_2$, length $L_2$ and angular disposition "beta" from the vertical. Preferably angle "alpha" is about 10 degrees and angle "beta" is about 60 degrees. Powdered pitch is supplied to upper chamber 15 of rotor 1. Thereafter the melt is contained in supply holes 21 and spinning holes 22 in order to minimize atmospheric contact leading to tar and coke formation, achieving thereby increased spinning continuity. Pitch is spun off the upper periphery 22 of the orifice 23 of the spinning hole 21, a condition which is favored by the following design considerations: $D_2$ is from 20 to 100 mils; $L_1/D_1=(k)L_2/D_2$ where k equals 1.5 to 2; $L_2/D_2=5$ to 10, and $D_2/D_1$ is less than or equal to 0.5. Further details respecting the rotor of FIG. 2 are provided in the Example.

Figure 3:
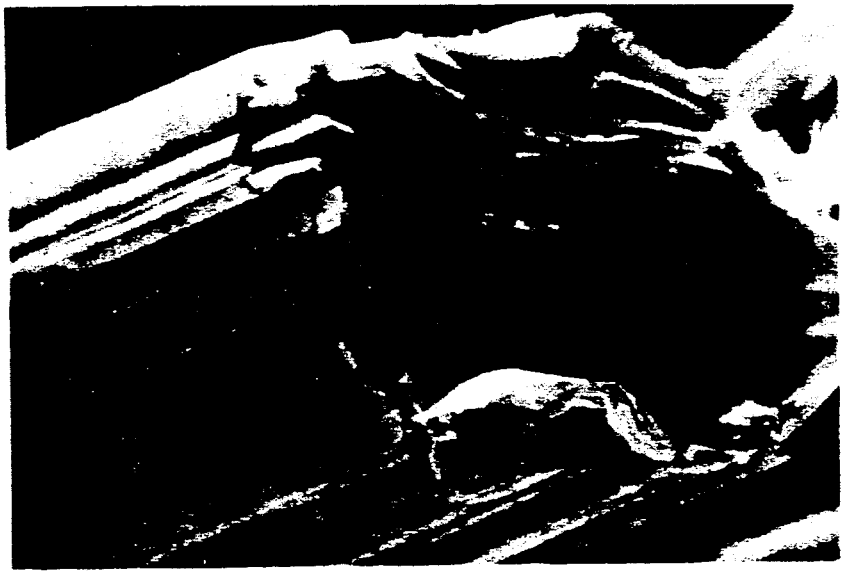

FIG. 3 shows in cross-section the fracture surface of a pitch fiber centrifugally spun from a lip in accordance with the foregoing discussion. The fiber was sectioned (broken) with a razor blade, inclined to better display the microstructural features, then a SEM photograph was taken at 10,000× magnification.

The lamellar structure is readily apparent. Overall the fiber cross-section is elliptical, the lamellae are generally parallel to the major axis of the ellipse and they extend to the periphery of the fiber. The lateral spacing between lamellae does not appear to be regular but groups of lamellae tend to "parallel" one another, usually in an isoclinic (i.e., contour-following) relationship.

EXAMPLE

Figure 1:
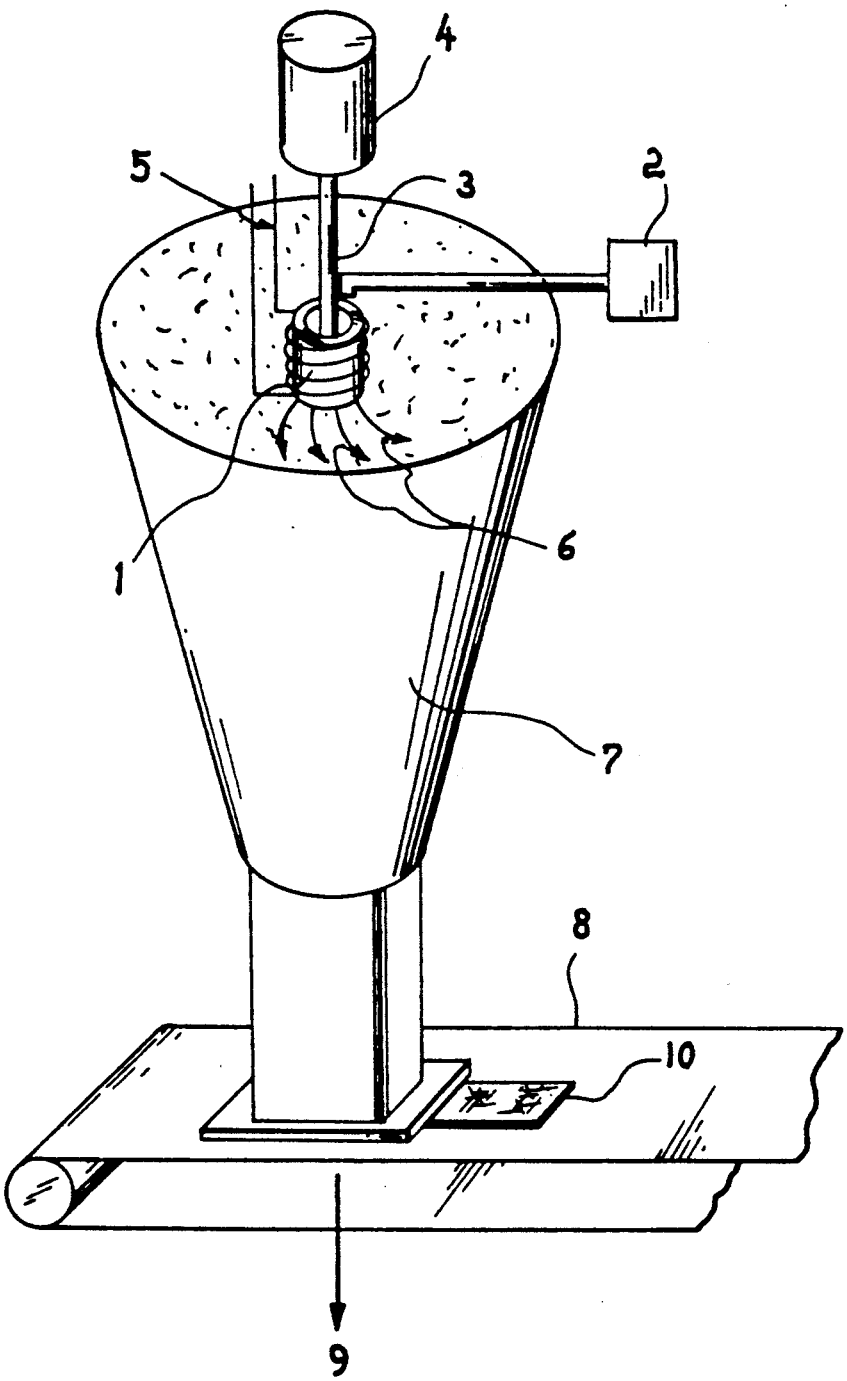
Referring to FIG. 1, solid pitch is introduced (metered) into the spinning rotor 1 by feed means 2 which, in the embodiment shown, is a screw feeder. Spinning rotor 1 is mounted on drive shaft 3 which, in turn, is driven at high rates of revolution by drive means 4. Spinning rotor 1 is surrounded by heating means 5 which, in this embodiment, is depicted as an electric induction coil. The pitch is melted in rotor 1 via heating means 5 and centrifugally spun into fibers, the trajectory of which is shown by arrows 6, into the collection means 7, a conical container installed around the rotor 1 with apex lying vertically below the rotor. The apex is connected to an exit channel. The maximum diameter of the conical container should be at least 5 to 12× larger than that of the rotor. The container is covered (cover not shown) except for openings to permit introduction of a gas, e.g., air or nitrogen, which may or may not be heated, circumferentially at the top and also through an opening above and surrounding the rotor. An endless screen conveyor belt 8, is placed in the path of the exit channel which is connected to vacuum source 9. While the fibers are collected in the form of a random batt 10 on belt 8, the gas passing through the batt 10 controls fiber deposition.

A supply of decant oil was heat soaked with nitrogen sparging to provide a 100% mesophase pitch having a softening point of 276° C. and a melting point of 305.5° C. The pitch was centrifugally spun using the rotor shown in FIG. 2 at an inductively heated wall temperature of 530° C. using otherwise the apparatus of FIG. 1. The rotor diameter was 3.25 inches; the twelve (12) supply holes 20 were 1.5 inches in length, 0.159 inches in diameter and inclined 10 degrees from the vertical; the corresponding spinning holes 21 were 0.375 inches in length, 0.0595 inches in diameter (ca. 1500 micrometers) and inclined 60 degrees from the vertical. The rotational speed was 17,000 rpm (13,340 g's) and the rate of feed of the pitch to the rotor was 1.0 pound per hour. As-spun fibers were collected on a moving wire screen to provide a batt having an areal density of 200 grams per square meter. Individual fibers were nearly round in cross-section, had an average width of 4 micrometers and an average length in excess of 10 centimeters. Spinning was continued for two (2) hours with consistent and uninterrupted production of such fibers in batt form. A sample of this batt was stabilized in air at 240° C. for 5 minutes then at 300° C. for 25 minutes. Precarbonization, carbonization and graphitization were accomplished sequentially by heating in an oven containing an argon atmosphere from room temperature to 2850° C. then holding at that temperature for 5 minutes. The resulting graphitized batt was cut. Most fibers exhibited the characteristic lamellar microstructure such as that shown in FIG. 3.

I claim:

1. In a process for preparing carbon fibers from mesophase pitch comprising centrifugally spinning a molten mesophase pitch at a temperature of 375° C. to 550° C. over the lip of a rotor at a centrifugal force of from 200 to 25000 g, the improvement comprising dividing the molten pitch into multiple discrete streams within the rotor, the streams being confined in channels which extend to said lip.

2. The process of claim 1 wherein the channels are tubular conduits.

3. The process of claim 1 wherein the channels are cylindrical conduits.

4. The process of claim 3 wherein the channels comprise two connected cylindrical portions, a larger diameter upstream portion having a length $L_1$ and a diameter $D_1$, and a smaller diameter downstream portion having a length $L_2$ and a diameter $D_2$.

5. The process of claim 4 wherein D is from 20 to 100 mils, $L_1/D_2=(k)L_2/D_2$ where k is from 1.5 to 2, $L_2/D_2$ equals from 5 to 10, $D_2/D_1$ is less than or equal to 0.5, the upstream portion of the channels are at an angle of incline of from 5 to 15 degrees to the axis of the rotor, and the downstream portion of the channels are at an angle of 55 to 65 degrees to the axis of the rotor.

6. The process of claims 1, 2, 3, 4 or 5 wherein the pitch is 100% mesophase and is spun with a centrifugal force of at least 1000 g.

* * * * *